US009833652B2

(12) United States Patent
Holt et al.

(10) Patent No.: US 9,833,652 B2
(45) Date of Patent: Dec. 5, 2017

(54) RESISTANCE BAND SYSTEMS

(71) Applicants: Dennis Holt, White Rock (CA); Shane Pilcher, White Rock (CA)

(72) Inventors: Dennis Holt, White Rock (CA); Shane Pilcher, White Rock (CA)

( * ) Notice: Subject to any disclaimer, the term of this patent is extended or adjusted under 35 U.S.C. 154(b) by 0 days.

(21) Appl. No.: 15/147,388

(22) Filed: May 5, 2016

(65) Prior Publication Data

US 2017/0319891 A1 Nov. 9, 2017

(51) Int. Cl.

| | |
|---|---|
| ***A63B 21/04*** | (2006.01) |
| ***A63B 21/055*** | (2006.01) |
| *A63B 21/045* | (2006.01) |
| *A63B 21/00* | (2006.01) |
| *A63B 22/00* | (2006.01) |

(52) U.S. Cl.

CPC ..... *A63B 21/04* (2013.01); *A63B 21/0557* (2013.01); *A63B 21/00061* (2013.01); *A63B 21/045* (2013.01); *A63B 21/0442* (2013.01); *A63B 21/4035* (2015.10); *A63B 22/0002* (2013.01)

(58) Field of Classification Search

CPC ..... A63B 21/00; A63B 21/04; A63B 21/0557; A63B 21/00058; A63B 21/00061; A63B 21/0442; A63B 21/045; A63B 21/4035; A63B 22/0002

USPC ..... 130/130, 142, 140, 123

See application file for complete search history.

(56) References Cited

U.S. PATENT DOCUMENTS

| | | | | |
|---|---|---|---|---|
| 6,099,445 | A * | 8/2000 | Rovinsky | A63B 21/0552 482/121 |
| 6,117,056 | A | 9/2000 | Cataldi et al. | |
| 6,500,104 | B1 * | 12/2002 | Rich | A63B 21/04 482/123 |
| 7,083,555 | B1 | 8/2006 | McPartland | |
| 7,229,392 | B2 | 6/2007 | Turnbull et al. | |
| 7,637,855 | B2 | 12/2009 | Bizzell et al. | |
| 7,708,670 | B2 * | 5/2010 | Bowser | A63B 21/055 482/57 |
| 7,955,238 | B2 | 6/2011 | Dokshutsky | |
| 8,162,809 | B1 | 4/2012 | Eastwood | |
| 8,303,472 | B2 | 11/2012 | Bowser | |

(Continued)

*Primary Examiner* — Loan H Thanh
*Assistant Examiner* — Megan Anderson
(74) *Attorney, Agent, or Firm* — Integrity Patent Group, PLC; Edwin Wold

(57) ABSTRACT

A resistance band system including a frame-assembly, a plurality of linear-straps, and a plurality of removable-D-rings. The frame-assembly, the plurality of linear-straps and plurality of removable-D-rings of the resistance band system are structured and arranged in combination to allow a user to affix a linear-resistance-band to the resistance band system to provide an overall exercise system which provides the user with a plurality of locations to affix the linear-resistance-band to the resistance band system to allow a highly flexible and diverse exercise system to the user. The frame-assembly includes an upper-frame, a lower-frame, and a u-member. The upper-frame includes two primary-members, two inbars, two forward-bars, and a crown-bar. The lower-frame includes two first-members, two downbars, and down-cross-member. The u-member comp includes rises a body, two legs, and two t-couplers, with u-member rotatably coupled to the lower-frame via the two t-couplers.

20 Claims, 5 Drawing Sheets

(56) References Cited

U.S. PATENT DOCUMENTS

| | | | |
|---|---|---|---|
| 2004/0087420 | A1 | 5/2004 | Montesquieux |
| 2006/0194679 | A1 | 8/2006 | Hatcher |
| 2010/0016134 | A1 | 1/2010 | Reese |
| 2014/0228184 | A1 | 8/2014 | Kamenshkikh |

* cited by examiner

RESISTANCE BAND SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of fitness accessories and more specifically relates to resistance band systems.

2. Description of Related Art

Strength and resistance training are types of exercise using resistance to procure muscular contraction which can be accomplished with weights, body weight exercises, machines, resistance bands, or other similar means. Such contraction is intended to build strength and endurance of muscles, joints, and ligaments of the body. Strength training can provide significant functional benefits and improvement in overall health and well-being. Benefits may include increased bone, muscle, tendon, and ligament strength, volume, and durability; improved joint function, and reduced potential for injury. Strength training provides benefits for both male and female participants.

Strength and resistance training also provides for rehabilitative benefits. For many people in rehabilitation strength training for weak or injured muscles is a necessity. However, standard weight lifting is not the preferred method of training for such individuals. A resistance band (or elastic band, rubber band, training band, etc.) is a popular alternative to weight training for many individuals.

A resistance band is an elastic or rubberized band used for strength training. Such bands are also commonly used in physical therapy and low impact training. Generally such resistance bands are available in a standard length with handles on opposing ends. Also, the user must provide the attachment means for affixing the end of the resistance band opposite the user. Therefore a suitable solution is desired.

Several attempts have been made to solve the above-mentioned problems such as those found in U.S. and Foreign Pat. and Pub. Nos. U.S. Pat. No. 6,117,056 to Cataldi et al.; U.S. Pat. No. 6,500,104 to Rich; U.S. Pat. No. 7,083,555 to McPartland; U.S. Pat. No. 7,229,392 to Turnbull et al.; U.S. Pat. No. 7,637,855 to Bizzell et al.; U.S. Pat. No. 7,955,238 to Dokshutsky; U.S. Pat. No. 8,162,809 to Eastwood; U.S. Pat. No. 8,303,472 to Bowser; US 2014/0087420 to Montesquieux; US 20016/0194679 to Hatcher, US 2010/0016134 to Reese; US 2014/0228184 to Kamenshkikh; CA 2,526,571 to Nativ; CA 2,551,734 to Bowser; CA 2,737,312 to Bancher, and CA 2,855,488 to Lalaoua. This art is representative of fitness accessories. However, none of the above inventions and patents, taken either singly or in combination, is seen to describe the invention as claimed.

Preferably, a resistance band system should provide a variable, reliable, and durable system for an individual to exercise with rubberized or elastic bands while providing a wide range of movements and, yet would operate reliably and be manufactured at a modest expense. Thus, a need exists for a reliable resistance band system to avoid the above-mentioned problems.

BRIEF SUMMARY OF THE INVENTION

In view of the foregoing disadvantages inherent in the known fitness accessory art, the present invention provides a novel resistance band system. The general purpose of the present invention, which will be described subsequently in greater detail is to provide a device useful for a large range of exercises using rubberized or elastic band with the device being easily mobile and adaptable to a wide range of users.

A resistance band system is disclosed herein, in a preferred embodiment, comprising: a frame-assembly, a plurality of linear-straps, and a plurality of removable-D-rings in functional and structural combination. The frame-assembly, the plurality of linear-straps and plurality of removable-D-rings of the resistance band system are structured and arranged in combination to allow a user to affix a linear-resistance-band to the resistance band system to provide an overall exercise system which provides the user with a plurality of locations to affix the linear-resistance-band to the resistance band system to allow a highly flexible and diverse exercise system to the user.

The frame-assembly comprises an upper-frame, a lower-frame, and a u-member. The upper-frame comprises two primary-members, two inbars, two forward-bars, and a crown-bar, in functional and structural combination; and the lower-frame comprises two first-members, two downbars, and down-cross-member, also in functional and structural combination. The u-member comprises a body, two legs, and two t-couplers, in functional and structural and functional combination with u-member rotatably coupled to the lower-frame via the two t-couplers in the preferred embodiment.

In the preferred embodiment, the hinge comprises two upper-hinge-couplers, two lower-hinge-couplers, and a hinge-bar, in both structural and functional combination with the upper-frame coupled to the lower-frame via the hinge. The hinge is adjustable by the tightening and loosening of a fastener (in the preferred embodiment), and hinge is affixed to each of the lower-frame and the upper-frame via thumb screw. The preferred embodiment includes the frame-assembly constructed from a steel alloy for durability and longevity, with the frame-assembly powder coated for scratch resistant rust protection for the outdoors.

In the preferred embodiment, each of the linear-straps comprises a flat-body, two loops, and D-ring(s), in functional and structural combination. Similarly each removable-D-ring comprises a D-shaped-ring, a flat-shaped-body, and a hook-and-loop-affixer. One or more of the plurality of linear-straps are affixable to the upper-frame by the two loops of one of the linear-straps, each wrapping around one of each of the two primary-members. Similarly, one or more of plurality of linear-straps are affixable to the lower-frame by the two loops of one of the linear-straps each wrapping around one of each of the two first-members. Each of the linear-straps comprises a non-elastic material for strength and durability in use, and each of the linear-straps are preferably constructed of an anti-microbial material for sanitary purposes, in the preferred embodiment.

Preferably linear-resistance-band comprises an elastic-band; a handle; and a clip in functional combination. In the preferred embodiment, handle of the linear-resistance-band further comprises a locking-ring useful for adjusting a length of the elastic band and includes a cushioned-grip to provide comfort and additional-grip for the user during use. Each of the elastic-bands comprise a particular color, each particular color corresponding to a specific resistance at a specific elongation percentage.

A kit is also described herein, the kit including: a frame-assembly, a plurality of linear-straps, a plurality of removable-D-rings, at least one linear-resistance-band, and a set of user instructions.

Also disclosed, in a preferred embodiment, is a method of use for a resistance band system. The preferred method of use comprises the steps of: providing a resistance band system; assembling the resistance band system; placing the resistance band system in a position to allow a user to perform an exercise routine; commencing the exercise routine (by user); ceasing the exercise routine; adjusting the resistance band system to a second-position; commencing a second exercise routing; ceasing the second exercise routine; and disassembling the resistance band system.

The present invention holds significant improvements and serves as a resistance band system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, resistance band systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a fitness accessory and more particularly to a resistance band system as used to improve the overall effectiveness of exercising using resistance bands by providing a device which provides numerous attachment points and configurations for exercise with resistance bands.

Generally speaking, the resistance band system comprises a frame-assembly, a plurality of linear-straps, and a plurality of removable-D-rings. The frame-assembly, the plurality of linear-straps, and the plurality of removable-D-rings of the resistance band system are structured and arranged in combination to allow a user to affix a linear-resistance-band to the resistance band system to provide an overall exercise system which provides the user with a plurality of locations to affix the linear-resistance-band to the resistance band system to allow a highly flexible and diverse exercise system to the user.

Figure 1:
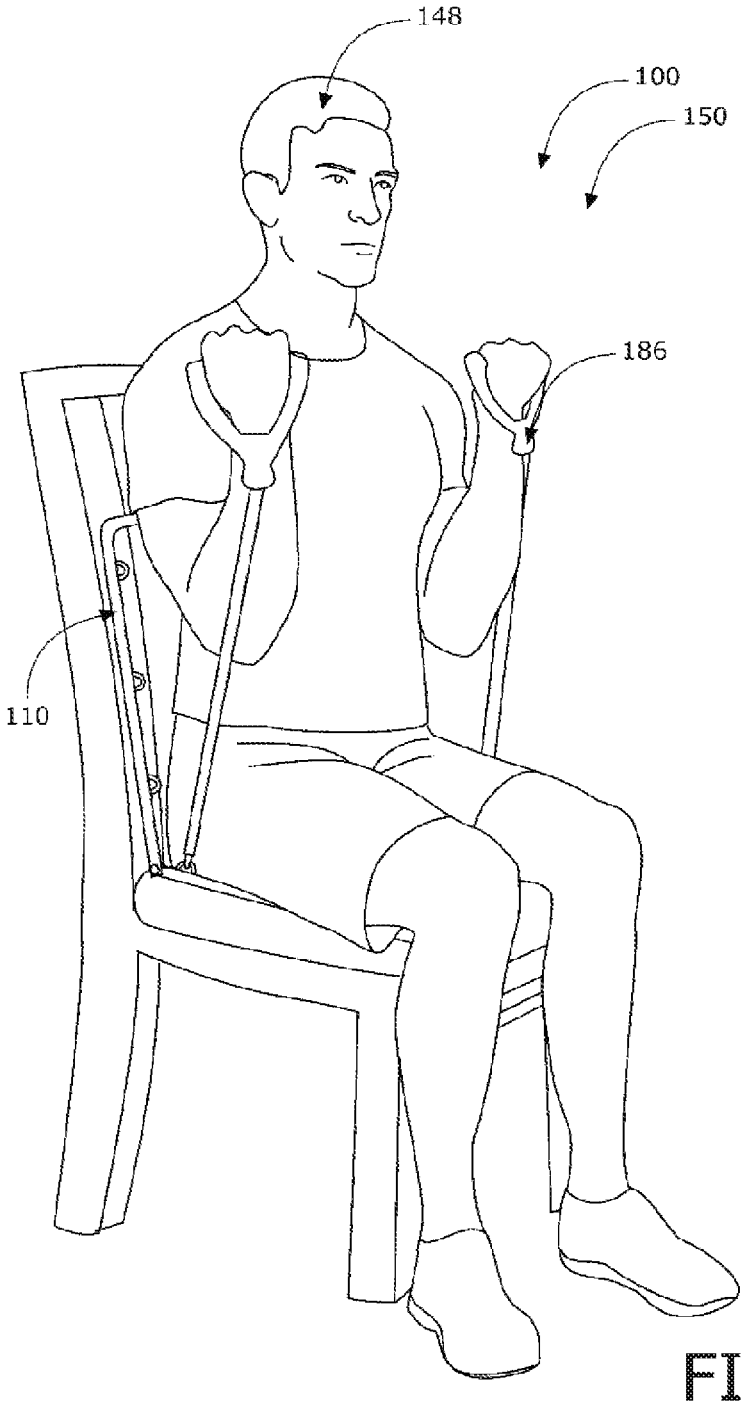
FIG. 1 shows a perspective view illustrating a resistance band system during an 'in-use' condition showing a user seated upon the frame-assembly of the resistance band system performing an exercise according to an embodiment of the present invention.

Referring to the drawings by numerals of reference there is shown in FIG. 1, resistance band system 100 during an 'in-use' condition, with user 148 sitting upon frame-assembly 110 and performing an exercise using linear-resistance-band 184.

Figure 2:
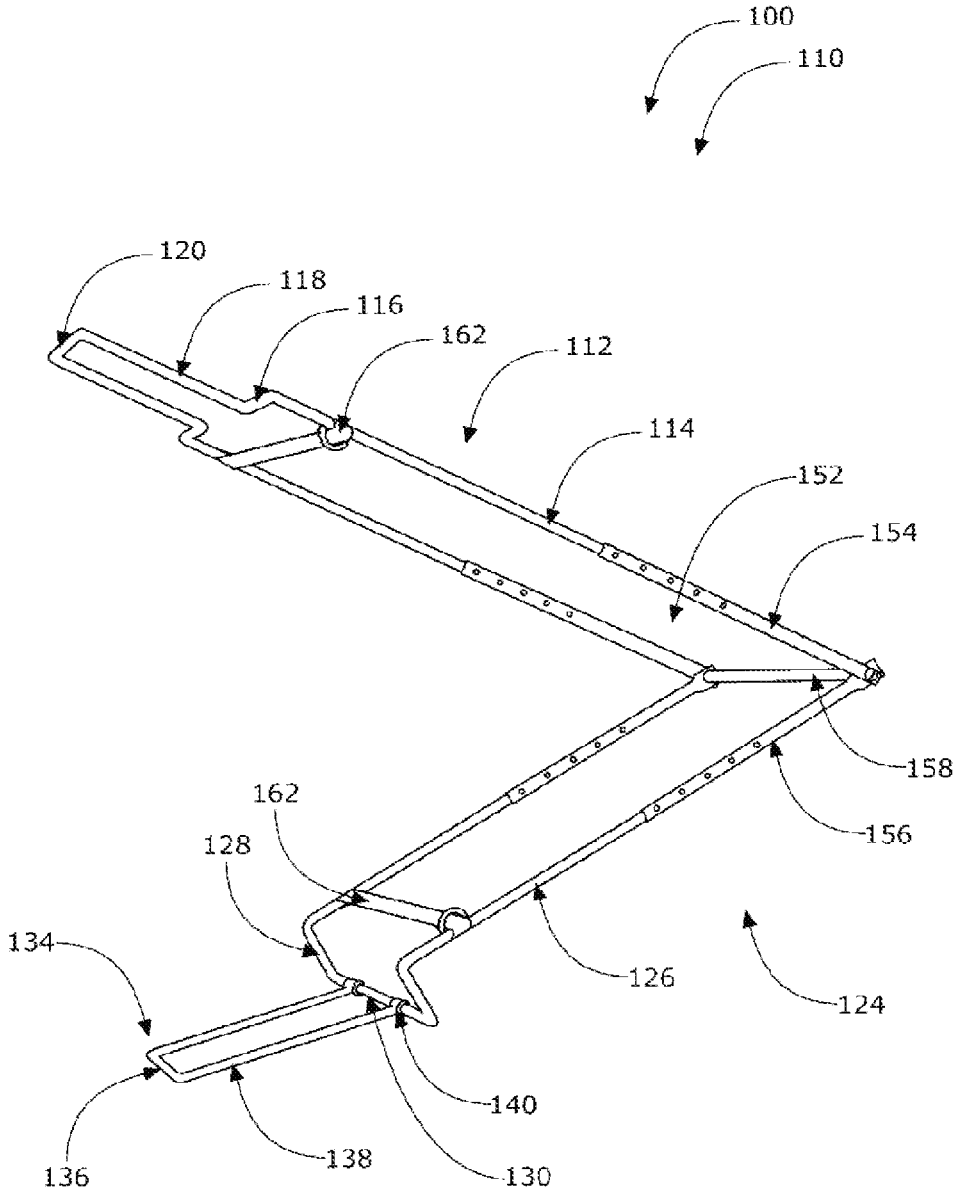
FIG. 2 is a perspective view illustrating the frame-assembly of the resistance band system comprising an upper-frame, a lower-frame, a u-member, and a hinge according to an embodiment of the present invention of FIG. 1.
Figure 3:
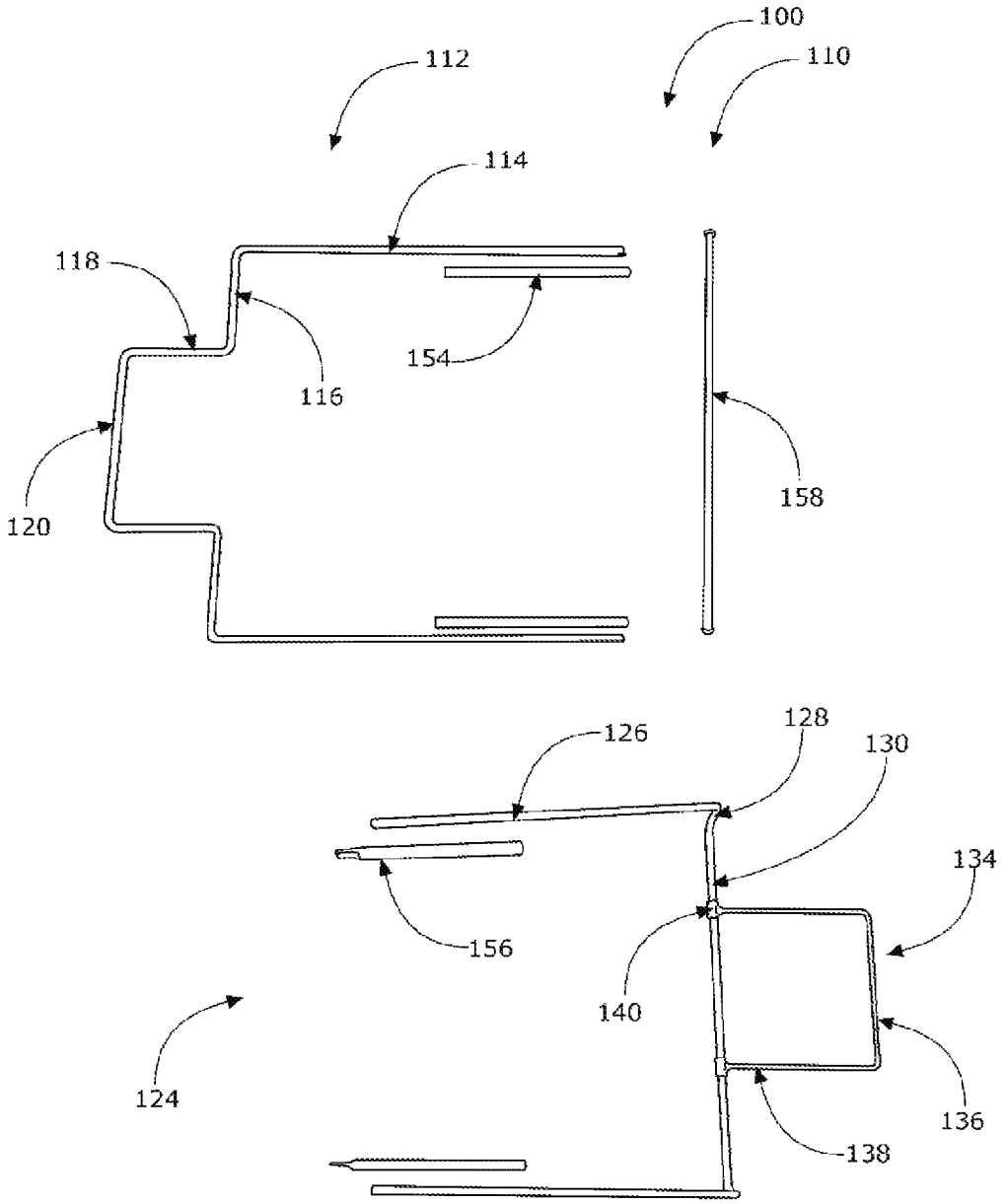
FIG. 3 is an exploded view illustrating the components of the frame-assembly of the resistance band system according to an embodiment of the present invention of FIGS. 1-2.

Referring now to FIGS. 2-3, resistance band system 100 may comprise frame-assembly 110, hinge 152, plurality of linear-straps 162, and plurality of removable-D-rings 170 in functional and structural combination. Frame-assembly 110 may comprise upper-frame 112, lower-frame 124, and u-member 134 (in structural combination). Upper-frame 112 may comprise two primary-members 114, two inbars 116, two forward-bars 118, and crown-bar 120; where lower-frame 124 may comprise two first-members 126, two down-bars 128, and down-cross-member 130; each of upper-frame 112 and lower-frame 124 in functional and structural combination. Upper-frame 112 may be coupled to lower-frame 124 via hinge 152. Hinge 152 may be adjustable by tightening and loosening of a fastener.

Referring still to FIGS. 2-3, u-member 134 may comprise body 136, two legs 138, and two t-couplers 140, in functional and structural. Hinge 152 may comprise two upper-hinge-couplers 154, two lower-hinge-couplers 156, and hinge-bar 158 in structural and functional combination. U-member 134 may be rotatably coupled to lower-frame 124 via two t-couplers 140.

Some embodiments of hinge 152 may be affixed to each of lower-frame 124 and upper-frame 112 via button-spring-clips. Hinge 152 may alternately affixed to each of lower-frame 124 and upper-frame 112 via pins or via biasers. Further, hinge 152 may be affixed to each of lower-frame 124 and upper-frame 112 via nuts-and-bolts.

Figure 4:
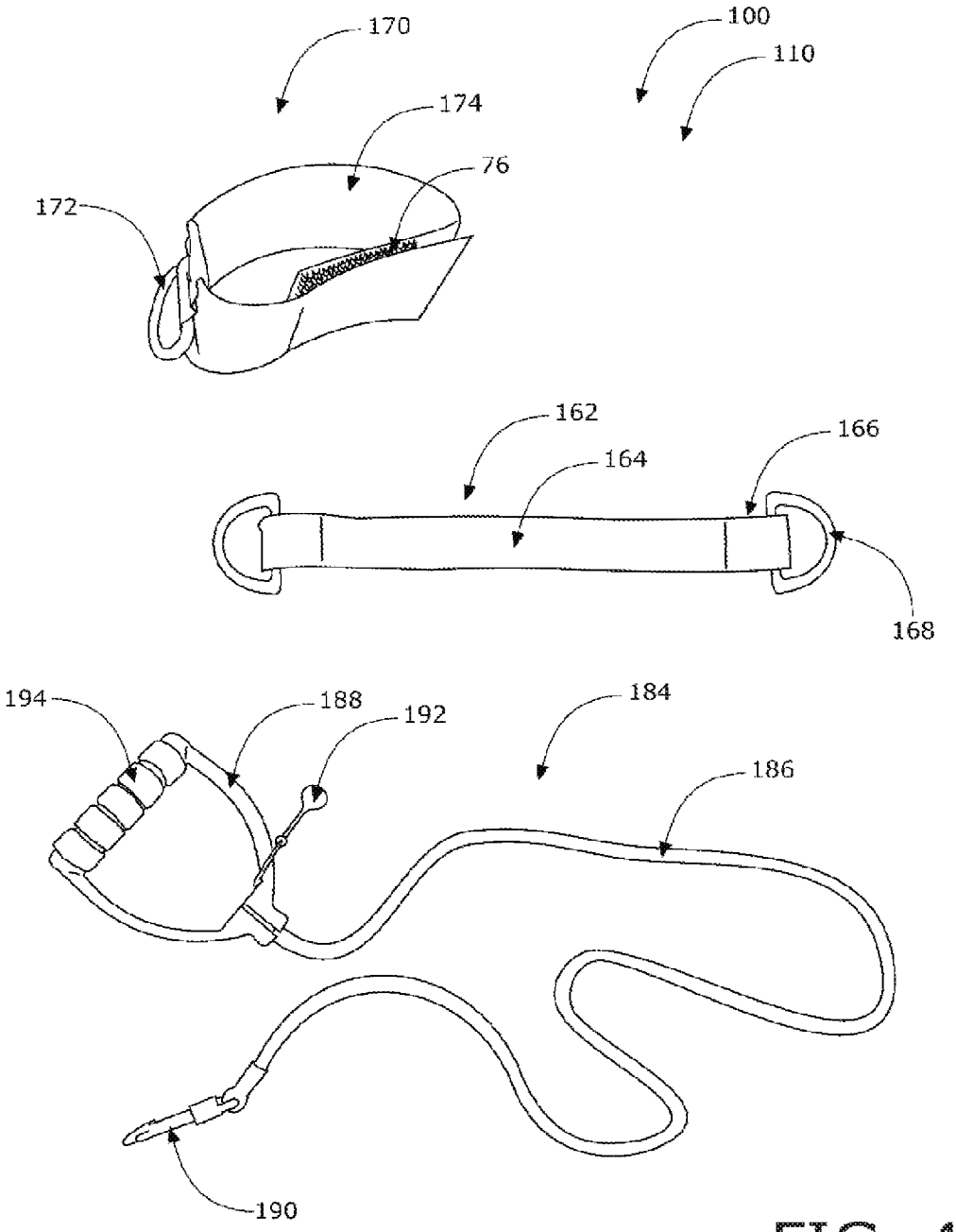
FIG. 4 is a perspective view illustrating one of the plurality linear-straps, one of the plurality of removable-D-rings, and a linear-resistance-band of the resistance band system according to an embodiment of the present invention of FIGS. 1-3.

Referring now to FIG. 4, each of linear-straps 162 may comprise flat-body 164, two loops 166, and D-ring(s) 168, in functional and structural combination. Each of removable-D-rings 170 may comprise D-shaped-ring 172, flat-shaped-body 174, and hook-and-loop-affixer 176. Linear-straps 162 may be affixed to upper-frame 112 via two loops 166 of one of linear-straps 162, with each loop 166 wrapping around one of each of two primary-members 114. Similarly, one or more of plurality of linear-straps 162 may be affixed to lower-frame 124 by two loops of one of linear-straps 162, each wrapping around one of each of two first-members 126.

Each of linear-straps 162 may comprise a non-elastic material for strength and durability in use. Additionally, linear-strap 162 may be constructed of an anti-microbial material for sanitary purposes.

Linear-resistance-band 184 may comprise elastic-band 186, handle 188, and clip 190 in functional combination. Handle 188 of linear-resistance-band 184 may comprise cushioned-grip 194 to provide comfort and additional-grip for user 148 during use. Additionally, handle 188 of linear-resistance-band 184 may comprise locking-ring 192 useful for adjusting the length of elastic-band 186 to accommodate different heights and weights of user. Elastic-band 186 may comprise a particular color, each particular color may correspond to a specific resistance at a specific elongation percentage.

Frame-assembly 110 may constructed from aluminum to be lightweight, yet suitably durable and easily transportable; or may be constructed from a steel alloy for durability and longevity. Further, frame-assembly 110 may be constructed from a plastic material to be lightweight, durable, and corrosion resistant. In some embodiments, frame-assembly 110 may be coated with a rubberized material to increase friction and durability. Other materials may be used in alternate embodiments.

A resistance band system 100 may be sold as kit 440 comprising the following parts: at least one frame-assembly 110; at least one linear-strap 162; at least one removable-D-ring 170; at least one linear-resistance-band 184; and at least one set of user instructions. The kit has instructions such that functional relationships are detailed in relation to the structure of the invention (such that the invention can be used, maintained, or the like in a preferred manner). Resistance band system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
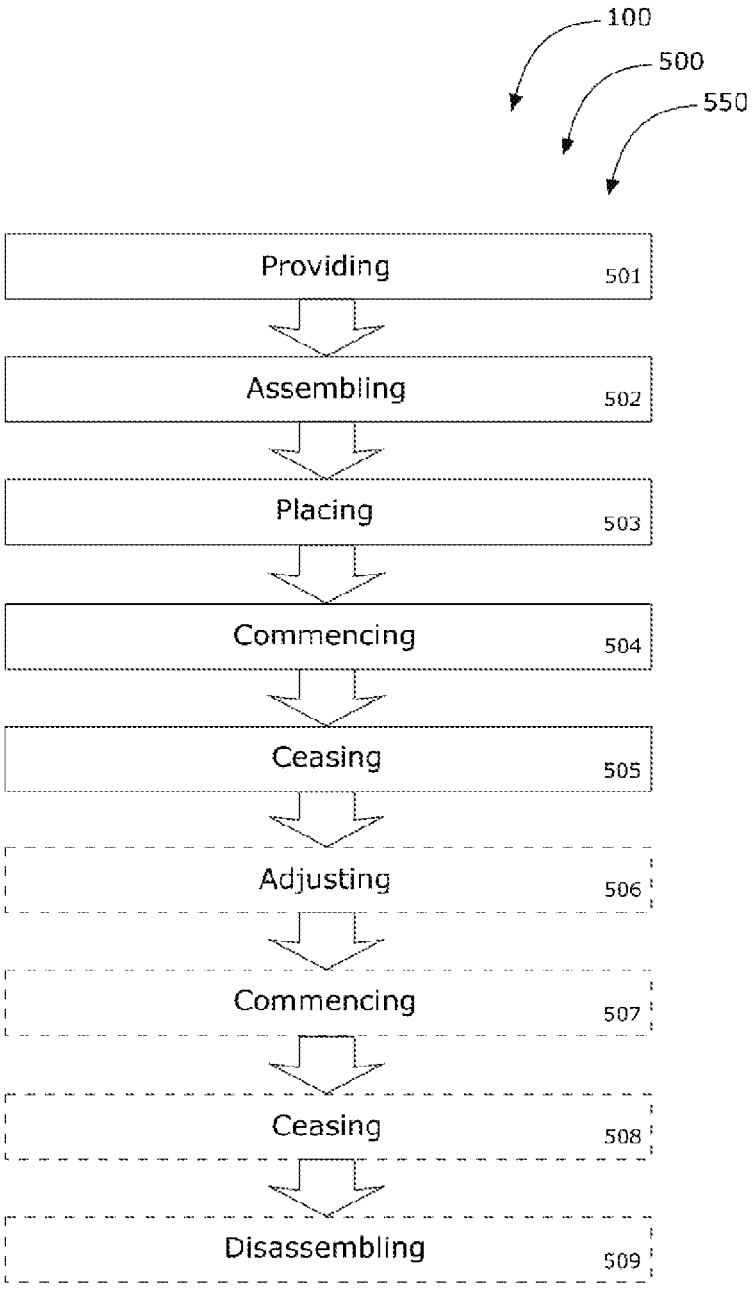
FIG. 5 is a flowchart illustrating a method of use for the resistance band system according to an embodiment of the present invention of FIGS. 1-4.

Referring now to FIG. 5 showing flowchart 550 illustrating method of use 500 for resistance band system 100 according to an embodiment of the present invention of FIGS. 1-4. As shown, method of use 500 may comprise the steps of: step one 501, providing resistance band system 100; step two 502, assembling resistance band system 100; step three 503, placing resistance band system 100 in a position to allow user 148 to perform at least one exercise routine; step four 504, commencing the exercise routine(s); step five 505, ceasing the exercise routine(s); step six 506, adjusting resistance band system 100 to a second-position; step seven 507, commencing at least one second exercise routine; step eight 508, ceasing the second exercise routine(s); and step nine 509, disassembling resistance band system 100.

It should be noted that step six 506, step seven 507, step eight 508, and step nine 509 are optional steps and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A resistance band system comprising a frame-assembly comprising:

a) an upper-frame comprising:
  i) two primary-members;
  ii) two inbars;
  iii) two forward-bars; and
  iv) a crown-bar;

b) a lower-frame comprising:
  i) two first-members;
  ii) two downbars; and
  iii) a down-cross-member;

c) a u-member comprising;
  i) a body;
  ii) two legs; and
  iii) two t-couplers;

d) a hinge comprising;
  i) two upper-hinge-couplers;
  ii) two lower-hinge-couplers; and
  iii) a hinge-bar;

e) a plurality of linear-straps each comprising;
  i) a flat-body;
  ii) two loops; and
  iii) a D-ring; and f) a plurality of removable-D-rings each comprising;
  i) a D-shaped-ring;
  ii) a flat-shaped-body; and
  iii) a hook-and-loop-affixer;

g) wherein said resistance band system comprises said frame-assembly, said hinge, said plurality of linear-straps, and said plurality of removable-D-rings in functional and structural combination;

h) wherein said frame-assembly comprises said upper-frame, said lower-frame, and said u-member;

i) wherein said upper-frame comprises said two primary-members, said two inbars, said two forward-bars, and said crown-bar, in functional and structural combination;

j) wherein said lower-frame comprises said two first-members, said two downbars, and said down-cross-member in functional and structural combination;

k) wherein said u-member comprises said body, said two legs, and said two t-couplers, in structural and functional combination;

l) wherein said hinge comprises said two upper-hinge-couplers, said two lower-hinge-couplers, and said hinge-bar in structural and functional combination;

m) wherein each of said linear-straps comprise said flat-body, said two loops, and said D-ring, in functional and structural combination;

n) wherein each of said plurality of removable-D-rings comprise said D-shaped-ring, said flat-shaped-body, and said hook-and-loop-affixer;

o) wherein said upper-frame is coupled to said lower-frame via said hinge;

p) wherein said u-member is rotatably coupled to said lower-frame via said two t-couplers;

q) wherein one or more of said plurality of linear-straps are affixable to said upper-frame by said two loops of said one or more of said linear-straps, each of the two loops wrapping around a respective one of said two primary-members;

r) wherein said one or more of said plurality of linear-straps are affixable to said lower-frame by said two loops of said one or more of said linear-straps, each of the two loops wrapping around a respective one of said two first-members; and s) wherein said frame-assembly, said plurality of linear-straps and plurality of removable-D-rings of said resistance band system are structured and arranged in combination to allow a user to affix a linear-resistance-band to said resistance band system to provide an overall exercise system which provides said user with a plurality of locations to affix said linear-resistance-band to said resistance band system to allow a highly flexible and diverse exercise system to said user.

2. The resistance band system of claim 1 wherein said linear-resistance-band comprises an elastic-band; a handle; and a clip in functional combination.

3. The resistance band system of claim 2 wherein said handle of said linear-resistance-band comprises a locking-ring useful for adjusting a length of said elastic band.

4. The resistance band system of claim 2 wherein said handle of said linear-resistance-band comprises a cushioned-grip to provide comfort and additional-grip for said user during use.

5. The resistance band system of claim 2 wherein said linear-resistance band comprises a plurality of linear-resistance bands, and wherein each of said elastic-bands of the plurality of linear-resistance bands comprise a particular color; each said particular color corresponding to a specific resistance at a specific elongation percentage.

6. The resistance band system of claim 1 wherein each of said plurality of linear-straps comprises a non-elastic material for strength and durability in use.

7. The resistance band system of claim 1 wherein each of said plurality of linear-straps are constructed of an anti-microbial material for sanitary purposes.

8. The resistance band system of claim 1 wherein said hinge is adjustable by tightening and loosening of a fastener.

9. The resistance band system of claim 1 wherein said hinge is affixed to each of said lower-frame and said upper-frame via button-spring-clips.

10. The resistance band system of claim 1 wherein said hinge is affixed to each of said lower-frame and said upper-frame via pins.

11. The resistance band system of claim 1 wherein said hinge is affixed to each of said lower-frame and said upper-frame via biasers.

12. The resistance band system of claim 1 wherein said hinge is affixed to each of said lower-frame and said upper-frame via nuts-and-bolts.

13. The resistance band system of claim 1 wherein said frame-assembly is constructed a from aluminum to be lightweight, durable and easily transportable.

14. The resistance band system of claim 1 wherein said frame-assembly is constructed from a steel alloy for durability and longevity.

15. The resistance band system of claim 1 wherein said frame-assembly is constructed from a plastic material to be lightweight, durable, and corrosion resistant.

16. The resistance band system of claim 1 wherein said frame-assembly is coated with a rubberized material to increase friction and durability.

17. A resistance band system comprising a frame-assembly comprising:

a) an upper-frame comprising:
   i) two primary-members;
   ii) two inbars;
   iii) two forward-bars; and
   iv) a crown-bar;

b) a lower-frame comprising:
   i) two first-members;
   ii) two downbars; and
   iii) a down-cross-member;

c) a u-member comprising:
   i) a body;
   ii) two legs; and
   iii) two t-couplers;

d) a hinge comprising:
   i) two upper-hinge-couplers;
   ii) two lower-hinge-couplers; and
   iii) a hinge-bar;

e) a plurality of linear-straps each comprising:
   i) a flat-body;
   ii) two loops; and
   iii) a D-ring; and f) a plurality of removable-D-rings each comprising:
   i) a D-shaped-ring;
   ii) a flat-shaped-body; and
   iii) a hook-and-loop-affixer;

g) wherein said resistance band system comprises said frame-assembly, said hinge, said plurality of linear-straps, and said plurality of removable-D-rings in functional and structural combination;

h) wherein said frame-assembly comprises said upper-frame, said lower-frame, and said u-member;

i) wherein said upper-frame comprises said two primary-members, said two inbars, said two forward-bars, and said crown-bar, in functional and structural combination;

j) wherein said lower-frame comprises said two first-members, said two downbars, and said down-cross-member in functional and structural combination;

k) wherein said u-member comprises said body, said two legs, and said two t-couplers, in function and structural combination;

l) wherein said hinge comprises said two upper-hinge-couplers, said two lower-hinge-couplers, and said hinge-bar in structural and functional combination;

m) wherein each of said linear-straps comprise said flat-body, said two loops, and said D-ring, in functional and structural combination;

n) wherein each of said plurality of removable-D-rings comprise said D-shaped-ring, said flat-shaped-body, and said hook-and-loop-affixer;

o) wherein said upper-frame is coupled to said lower-frame via said hinge;

p) wherein said u-member is rotatably coupled to said lower-frame via said two t-couplers;

q) wherein one or more of said plurality of linear-straps are affixed to said upper-frame by said two loops of said one or more of said linear-straps, each of the two loops wrapping around a respective one of said two primary-members;

r) wherein said one or more of said plurality of linear-straps are affixed to said lower-frame said two loops of said one or more of said linear-straps, each of the two loops wrapping around a respective one of said two first-members;

s) wherein said frame-assembly, said plurality of linear-straps and plurality of removable-D-rings of said resistance band system are structured and arranged in combination to allow a user to affix a linear-resistance-band to said resistance band system to provide an overall exercise system which provides said user with a plurality of locations to affix said linear-resistance-band to said resistance band system to allow a highly flexible and diverse exercise system to said user;

t) wherein said linear-resistance-band comprises an elastic-band; a handle; and a clip in functional combination;

u) wherein said handle of said linear-resistance-band comprises a locking-ring for adjusting a length of said elastic-band;

v) wherein said handle of said linear-resistance-band comprises a cushioned-grip to provide comfort and additional-grip for said user during use;

w) wherein said linear-resistance band comprises a plurality of linear-resistance bands, and wherein each of said elastic-bands of the plurality of linear-resistance bands comprise a particular color; each said particular color corresponding to a specific resistance at a specific elongation percentage;

x) wherein each of said linear-straps comprises a non-elastic material for strength and durability in use;

y) wherein each of said linear-straps are constructed of an anti-microbial material for sanitary purposes;

z) wherein said hinge is adjustable by tightening and loosening of a fastener;

aa) wherein said hinge is affixed to each of said lower-frame and said upper-frame via button-spring-clips;

bb) wherein said frame-assembly is constructed from a steel alloy for durability and cc) longevity; and dd) wherein said frame-assembly is coated with a rubberized material to increase friction and durability.

18. A method of using the resistance band system of claim 17 comprising the steps of:

a) providing the resistance band system;

b) assembling said resistance band system;

c) placing said resistance band system in a position to allow the user to perform an exercise routine;

d) commencing said exercise routine; and e) ceasing said exercise routine.

19. The method of claim 18 further comprising the steps of:

a) adjusting said resistance band system to a second-position;

b) commencing a second exercise routing;

c) ceasing said second exercise routine; and d) disassembling said resistance band system.

20. The resistance band system of claim 17 further comprising a kit including:

a) said frame-assembly;

b) said plurality of linear-straps;

c) said plurality of removable-D-rings; said d) at least one linear-resistance band of the plurality of linear-resistance bands; and e) a set of user instructions.

* * * * *